United States Patent [19]

Martin

[11] Patent Number: 4,841,825

[45] Date of Patent: Jun. 27, 1989

[54] SAW CHAIN WITH WRAP-OVER DEPTH GAUGE

[75] Inventor: Kenneth B. Martin, Gresham, Oreg.

[73] Assignee: Blount, Inc., Montgomery, Ala.

[21] Appl. No.: 205,300

[22] Filed: Jun. 10, 1988

[51] Int. Cl.[4] ..... B27B 33/14

[52] U.S. Cl. ..... 83/833; 83/834

[58] Field of Search ..... 83/831, 832, 833, 834, 83/830

[56] References Cited

FOREIGN PATENT DOCUMENTS 3539334 7/1987 Fed. Rep. of Germany ..... 83/834

262364 5/1970 U.S.S.R. ..... 83/834

*Primary Examiner*—Donald R. Schran

*Attorney, Agent, or Firm*—Klarquist, Sparkman, Campbell, Leigh & Whinston

[57] ABSTRACT

A cutting link for a saw chain useful in heavy workload operations includes spaced-apart longitudinally-extending planar side portions adapted to straddle a guide bar support and a cutting element mounted on one of the side portions and extending toward the other side portion, the side portions being connectable to other links in the chain. A cross piece interconnects the side portions forwardly of the cutting element. The cross piece forms with the side portions a continuous U-shaped zone which defines a depth gauge to determine the depth of cut of the cutting element. A depending nose tab integral with the cross-piece serves to close off a portion of the forward open channel between the planar side portions to minimize accumulation and packing of sawdust under the U-shaped zone.

6 Claims, 1 Drawing Sheet

SAW CHAIN WITH WRAP-OVER DEPTH GAUGE

BACKGROUND OF THE INVENTION

This invention relates to saw chains for chain saws.

Chain saw equipment typically used for heavy workload operations, as for example, equipment used in tree falling machines, frequently is of the straddle-chain type. The chain runs on a one-piece non-grooved guide bar, over which the chain links fit as they travel around the bar. The cutting links typically are of relatively large pitch, for example, they may be of of two and one-half inch pitch. This type of chain makes it possible to achieve a complete balance of cutting forces on both sides of the saw bar, which is important for large pitch cutters and allows use of roller chain technology in the chassis portion of the chain.

Prior art cutters of this type have experienced deficiencies in service. Such prior art cutters have had side portions, or flanks, connected together by welding a portion of round bar stock between them to create a set spacing. A cutting element is typically mounted on one of the side portions. The welding, however, created a weak point which often caused the cutting element to break away from the flank while experiencing a cutting load.

Accordingly, it is a principal object of the present invention to provide a cutting link for a large pitch saw chain that will eliminate the need for any welded portion, thus to eliminate any weak points in the cutter.

A further object of the present invention is to provide a cutter of the aforementioned type for use in heavy workload operations which will not be subject to failure under cutting loads.

A still further object of the present invention is to provide a cutter of the aforementioned type that will have the advantage of reduced manufacturing cost because fabrication expense associated with welding several components together will be avoided.

SUMMARY OF THE INVENTION

The cutting chain of my invention includes a plurality of links. Predetermined ones of such links include a cutting portion mounted on one of a pair of spaced-apart, longitudinally-extending planar side portions which are adapted to straddle a guide bar support means. The side portions provide a means for connecting the cutting links to other links in the chain, for example, to roller chain links, which are used to connect the cutters into a continuous loop.

The cutting portion comprises a cutting tooth integral with the aforesaid one of the spaced-apart longitudinally-extending side portions. The tooth has a generally transversely-extending cutting edge. The cutting edge extends toward the other of the spaced-apart longitudinally-extending side portions.

The longitudinally-extending side portions are interconnected by a cross-piece forwardly of the cutting portion. The cross-piece and the side portions forwardly of the cutting portion form a continuous U-shaped zone. The zone defines a folded-over depth gauge which determines the depth of cut of the cutting portion.

A saw chain link having a folded-over depth gauge portion is disclosed in the patent application of Michael D. Harfst, Ser. No. 07/086,640, filed Aug. 18, 1987, now U.S. Pat. No. 4,813,323, issued Mar. 21, 1989. The subject matter of that invention and the instant invention were, at the time the instant invention was made, owned by or subject to an obligation of assignment to the assignee of the instant invention.

DESCRIPTION OF THE PREFERRED EMBODIMENT

Figure 1:
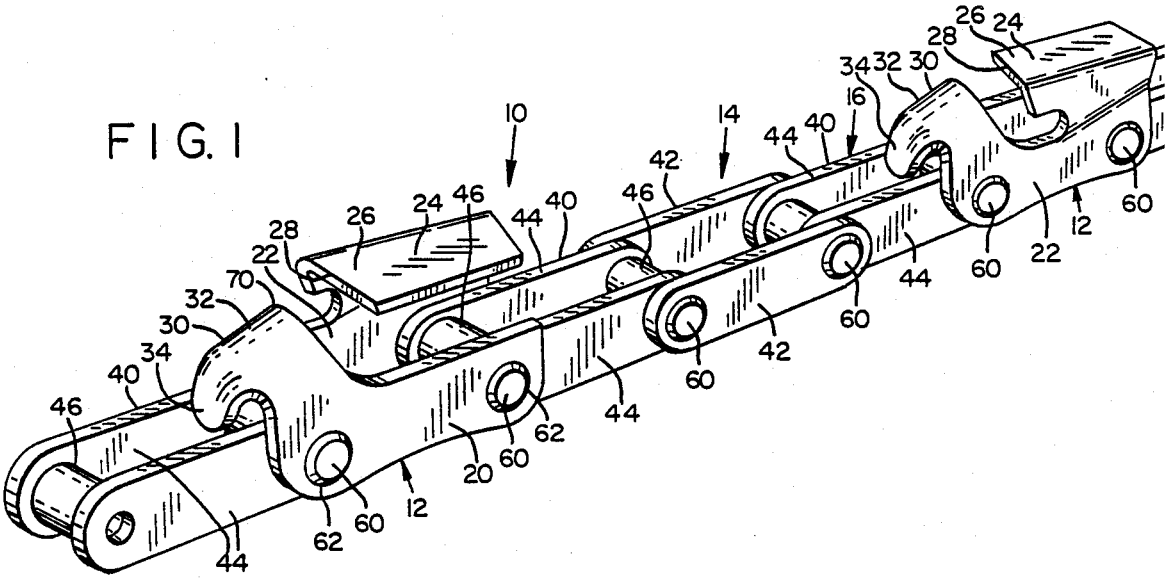
FIG. 1 is a perspective view of saw chain cutting apparatus in accordance with the present invention.

Referring to the drawings, saw chain cutting apparatus 10 according to the present invention includes a plurality of links 12, 14 connected to form a straddle chain 16 adapted to ride over a guide bar 18. The chain 16 and bar 18 are of a type suitable for heavy workload operations, as for example, tree falling machines.

Links 12 in chain 16 are the cutting links in the chain. Links 12 comprise a pair of spaced-apart longitudinally-extending planar side portions 20, 22 which are adapted to straddle bar 18 as shown. A cutting portion 24 is mounted on portion 22. Cutting portion 24 comprises a cutting tooth 26 formed integrally with portion 22. Tooth 26 has a generally transversely-extending cutting edge 28 which extends across guide bar 18 toward the other side portion 20 of link 12.

A cross-piece 30 forming a continuous U-shaped zone 32 interconnects portions 20, 22 forwardly of cutting portion 24. Cross-piece 30 slopes toward guide bar 18 forwardly of cutting tooth 26 such that zone 32 functions as a depth gauge to determine the depth of cut of cutting edge 28. A depending nose tab 34 integral with zone 32 serves to close off a portion of the forward open channel between portions 20, 22, thereby to minimize accumulation and packing of sawdust under zone 32.

Side portions 20, 22 provide means for connecting links 12 to inner links 40 which themselves are interconnected by side plates 42 to form chain 16. Each of links 40 comprises a pair of side plates 44 interconnected by rollers 46, which latter are adapted to ride on a center portion 48 of bar 18 as shown. The latter is undercut to form shoulders 50 to accommodate portions 20, 22 of links 12. Links 12 and 40 and side plates 42 are interconnected by rivets 60 having peened-over heads 62, thereby to create the necessary articulation for the chain.

Figure 2:
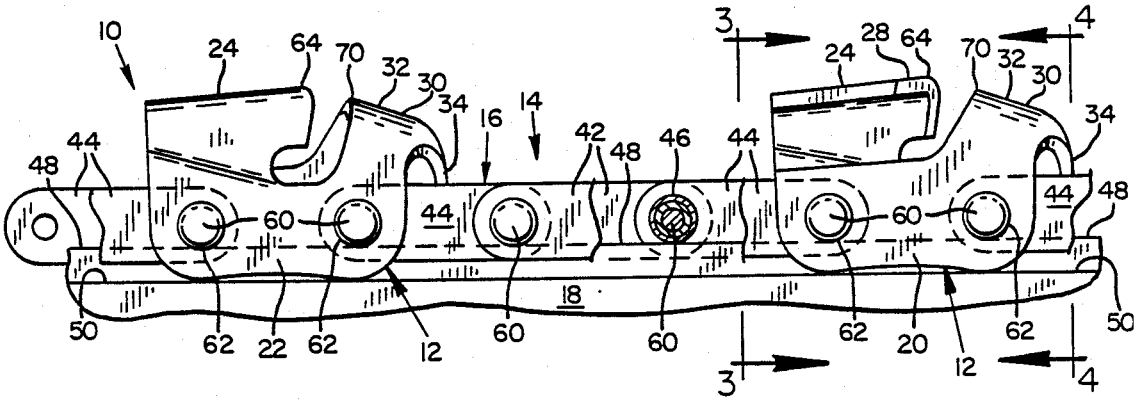
FIG. 2 is a side elevational view, with parts broken away, of the apparatus of FIG. 1.
Figure 3:
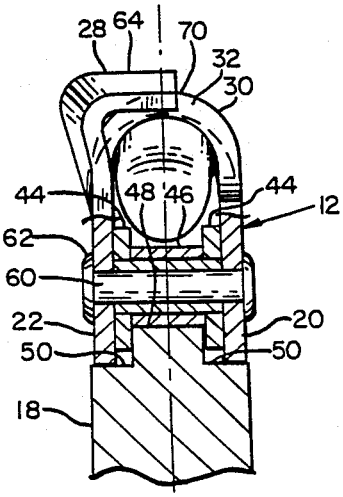
FIG. 3 is a sectional view taken on line 3—3 of FIG. 2.
Figure 4:
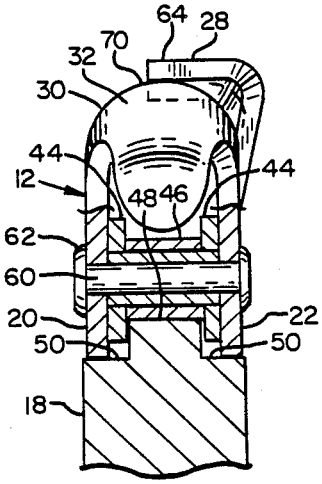
FIG. 4 is a sectional view taken on line 4—4 of FIG. 2.

In a preferred example rivets 60 are set at a pitch of $2\frac{1}{2}$ inches. Links 12 are made of 0.250 inch thick heat treated spherodized annealed 4140 steel. The cutter link is made by cutting the desired shape from plate material and subsequently forming it in a punch press die to the desired folded-over configuration. The high point 64 of cutting edge 28 of tooth 26 extends outwardly (upwardly as shown in FIGS. 2, 3 and 4) of the top point 70 of cross piece 30 a distance of 0.24 inch. Cross piece 30 may desirably extend $1\frac{1}{8}$ inches in a longitudinal direction along zone 32, the slop of zone 32 being 16 degrees toward the center line of chain 16. The height of portions 20,22 is 0.700 inch. Link 12 is four (4) inches long.

My integral link, with opposed, substantially parallel, plate sides, provides a four-point support for the cutter as it rides on the rail of the bar 18. The bottom portions of the cutter links 12 under the ends of the four rivets 60 all rest on the shoulders 50 of the bar 18 to provide stability and support for the cutting tooth 26 during operation.

My improved saw chain is not limited to an embodinent that runs on a guide bar. The chain can also be wrapped around and secured to the periphery of a disk o form a circular saw. In this case the chassis of the chain is snugly received in a groove in the disk periphery and rotates with the disk.

Having illustrated and described a preferred embodinent of my invention, it should be apparent to those killed in the art that the invention permits modification n arrangement and detail. I claim as my invention all uch modifications as come within the true spirit and cope of the following appended claims.

I claim:

1. In a saw chain cutting apparatus having a guide bar upport means, a plurality of links connected to form a chain, predetermined ones of said links having a cutting portion, spaced-apart longitudinally-extending planar side portions adapted to straddle said guide bar support means and forming a channel therebetween, said cutting portion being mounted on one of said side portions, said side portions providing means for connecting said predetermined ones of said links to others of the links in the chain, and a cross-piece interconnecting said side portions forwardly of said cutting portion, said cross-piece forming with said side portions a continuous U-shaped zone, said cutting portion comprising a cutting tooth integral with said one of said spaced-apart longitudinally-extending side portions, said tooth having a generally transversely-extending cutting edge, said cutting edge extending toward the other of said spaced-apart longitudinally-extending side portions, said U-shaped zone defining a depth gauge to determine the depth of cut of said cutting tooth.

2. The saw chain cutting apparatus of claim 1, in which the cross-piece interconnecting the side portions slopes toward the guide bar support means forwardly of the cutting tooth.

3. The saw chain cutting apparatus of claim 1, further comprising a nose tab depending forwardly from said cross-piece, said nose tab closing off a portion of the channel between the planar side portions.

4. The saw chain cutting apparatus of claim 1, further comprising a plurality of roller links, said side portions of said predetermined ones of said links being connected to said roller links.

5. In a saw chain including a plurality of connector links and cutter links, a cutter link having front and rear ends and comprising a pair of spaced-apart, longitudinally-extending, substantially parallel planar side portions extending substantially the length of said cutter link and straddling connector links adjacent the front and rear ends of the cutter link, means pivotally connecting said cutter link to the straddled connector links, a cross-piece interconnecting said side portions adjacent the front end of said cutter link, said cross-piece forming with said side-portions a continuous U-shaped zone, and a cutting portion mounted on one of said side portions rearwardly of said cross piece, said cutting portion comprising a cutting tooth integral with said one of said side portions, said tooth having a generally transversely-extending cutting edge extending toward the other of said side portions, said U-shaped zone defining a depth gauge to determine the depth of cut of said cutting tooth.

6. The saw chain cutting apparatus of claim 5, further comprising a nose tab depending forwardly from said cross-piece, said nose tab closing off a portion of the space between the planar side portions.

* * * * *